US012235029B2

(12) United States Patent
Yamaguchi

(10) Patent No.: US 12,235,029 B2
(45) Date of Patent: Feb. 25, 2025

(54) AIR-CONDITIONING SYSTEM WITH SEPARATE REFRIGERANT LEAK SENSORS

(71) Applicant: Mitsubishi Electric Corporation, Tokyo (JP)

(72) Inventor: Koji Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 171 days.

(21) Appl. No.: 17/796,004

(22) PCT Filed: Mar. 30, 2020

(86) PCT No.: PCT/JP2020/014568
§ 371 (c)(1),
(2) Date: Jul. 28, 2022

(87) PCT Pub. No.: WO2021/199163
PCT Pub. Date: Oct. 7, 2021

(65) Prior Publication Data
US 2023/0085125 A1 Mar. 16, 2023

(51) Int. Cl.
*F24F 11/36* (2018.01)
*F25B 13/00* (2006.01)
*F25B 49/02* (2006.01)

(52) U.S. Cl.
CPC ..... *F25B 49/02* (2013.01); *F24F 11/36* (2018.01); *F25B 13/00* (2013.01); *F25B 2313/0233* (2013.01); *F25B 2500/222* (2013.01)

(58) Field of Classification Search
None
See application file for complete search history.

(56) References Cited

U.S. PATENT DOCUMENTS

2003/0213254 A1* 11/2003 Koo ..... F25B 13/00 62/174
2014/0033754 A1 2/2014 Hatomura et al.
(Continued)

FOREIGN PATENT DOCUMENTS

CN 107923642 A 4/2018
EP 3 985 331 A1 4/2022
(Continued)

OTHER PUBLICATIONS

Examination Report dated Sep. 28, 2023 issued in corresponding GB Patent Application No. 2211658.6.
(Continued)

*Primary Examiner* — Jerry-Daryl Fletcher
*Assistant Examiner* — Daniel C Comings
(74) *Attorney, Agent, or Firm* — Posz Law Group, PLC

(57) ABSTRACT

An air-conditioning system includes an outdoor unit, a plurality of indoor units, and one or more refrigerant leak sensors. The outdoor unit is configured to exchange heat between outdoor air and refrigerant in a refrigerant circuit in which the refrigerant is circulated. The plurality of indoor units are each configured to exchange heat between the refrigerant and air inside a room in the refrigerant circuit and to perform air-conditioning inside the room. The one or more refrigerant leak sensors are each configured to detect a leak of the refrigerant from the refrigerant circuit. The one or more refrigerant leak sensors are each arranged separately from the outdoor unit and the plurality of indoor units.

1 Claim, 3 Drawing Sheets

(56) References Cited

U.S. PATENT DOCUMENTS

| | | | | |
|---|---|---|---|---|
| 2018/0283725 | A1 | 10/2018 | Ikawa et al. | |
| 2019/0226705 | A1 | 7/2019 | Sakae et al. | |
| 2020/0049384 | A1 | 2/2020 | Asanuma et al. | |
| 2020/0132321 | A1 * | 4/2020 | Blanton | F24F 11/77 |

FOREIGN PATENT DOCUMENTS

| | | | | |
|---|---|---|---|---|
| JP | 2012-013339 | A | 1/2012 | |
| JP | 2017-053509 | A | 3/2017 | |
| JP | 2018-009769 | A | 1/2018 | |
| WO | 2012/160598 | A1 | 11/2012 | |
| WO | WO-2018003096 | A1 * | 1/2018 | F24F 11/36 |
| WO | 2018/096576 | A1 | 5/2018 | |
| WO | WO-2021001869 | A1 * | 1/2021 | F24F 11/36 |

OTHER PUBLICATIONS

International Search Report of the International Searching Authority mailed Jun. 23, 2020 in corresponding International Patent Application No. PCT/JP2020/014568 (with English machine translation).
Office Action dated Oct. 26, 2024 issued in corresponding Chinese Patent Application No. 202080098994.9 (and English translation).

* cited by examiner

Comparative Example

AIR-CONDITIONING SYSTEM WITH SEPARATE REFRIGERANT LEAK SENSORS

CROSS REFERENCE TO RELATED APPLICATION

This application is a U.S. national stage application of PCT/JP2020/014568 filed on Mar. 30, 2020, the contents of which are incorporated herein by reference.

TECHNICAL FIELD

The present disclosure relates to an air-conditioning system including a plurality of indoor units, circulating refrigerant, and performing air-conditioning.

BACKGROUND

In recent years, as refrigerant used in an air-conditioning apparatus, in place of R410A, which has a high global warming potential, combustible refrigerant with a low GWP, such as R32, has been proposed. The combustible refrigerant, however, may leak from the inside of an indoor unit or from a section connected to the indoor unit. Because the combustible refrigerant has a higher specific gravity in many cases, when the refrigerant leaks, it tends to accumulate around the floor inside a room, inside the indoor unit, or in other areas and it is unlikely to diffuse.

Patent Literature 1 describes an air-conditioning system including an outdoor unit and a plurality of indoor units that are connected together and that can communicate with each other and including a refrigerant leak sensor disposed in each of the indoor units and configured to detect a leak of the refrigerant. When the refrigerant leak sensor detects the leak of the refrigerant, the air-conditioning system suspends its operation. Such a configuration can prevent further leaks of the refrigerant.

Patent Literature

Patent Literature 1: Japanese Unexamined Patent Application Publication No. 2017-053509

When the refrigerant leak sensor is mounted on the indoor unit, the following problems may occur. First, the refrigerant leak sensor in the air-conditioning system needs to be changed to change the type of refrigerant, to change the characteristics of the refrigerant leak sensor, to replace the refrigerant leak sensors because of age deterioration, or in other cases. When the number of indoor units in the air-conditioning system is large, the burden of work of replacing the refrigerant leak sensors for each of the indoor units is significant.

SUMMARY

The present disclosure is made to solve the above problems, and it is an object of the present disclosure to provide an air-conditioning system capable of reducing the burden of work of replacing refrigerant leak sensors.

An air-conditioning system according to an embodiment of the present disclosure includes an outdoor unit configured to exchange heat between outdoor air and refrigerant in a refrigerant circuit in which the refrigerant is circulated, a plurality of indoor units each configured to exchange heat between the refrigerant and air inside a room in the refrigerant circuit and to perform air-conditioning inside the room, and one or more refrigerant leak sensors each configured to detect a leak of the refrigerant from the refrigerant circuit. The one or more refrigerant leak sensors are each arranged separately from the outdoor unit and the plurality of indoor units.

In the air-conditioning system according to an embodiment of the present disclosure, because the one or more refrigerant leak sensors are each arranged separately from the outdoor unit and the indoor units, work for the outdoor unit and the indoor units in replacing the refrigerant leak sensors is not needed, and the burden of work of replacing the refrigerant leak sensors is to be reduced.

DETAILED DESCRIPTION

Figure 1:
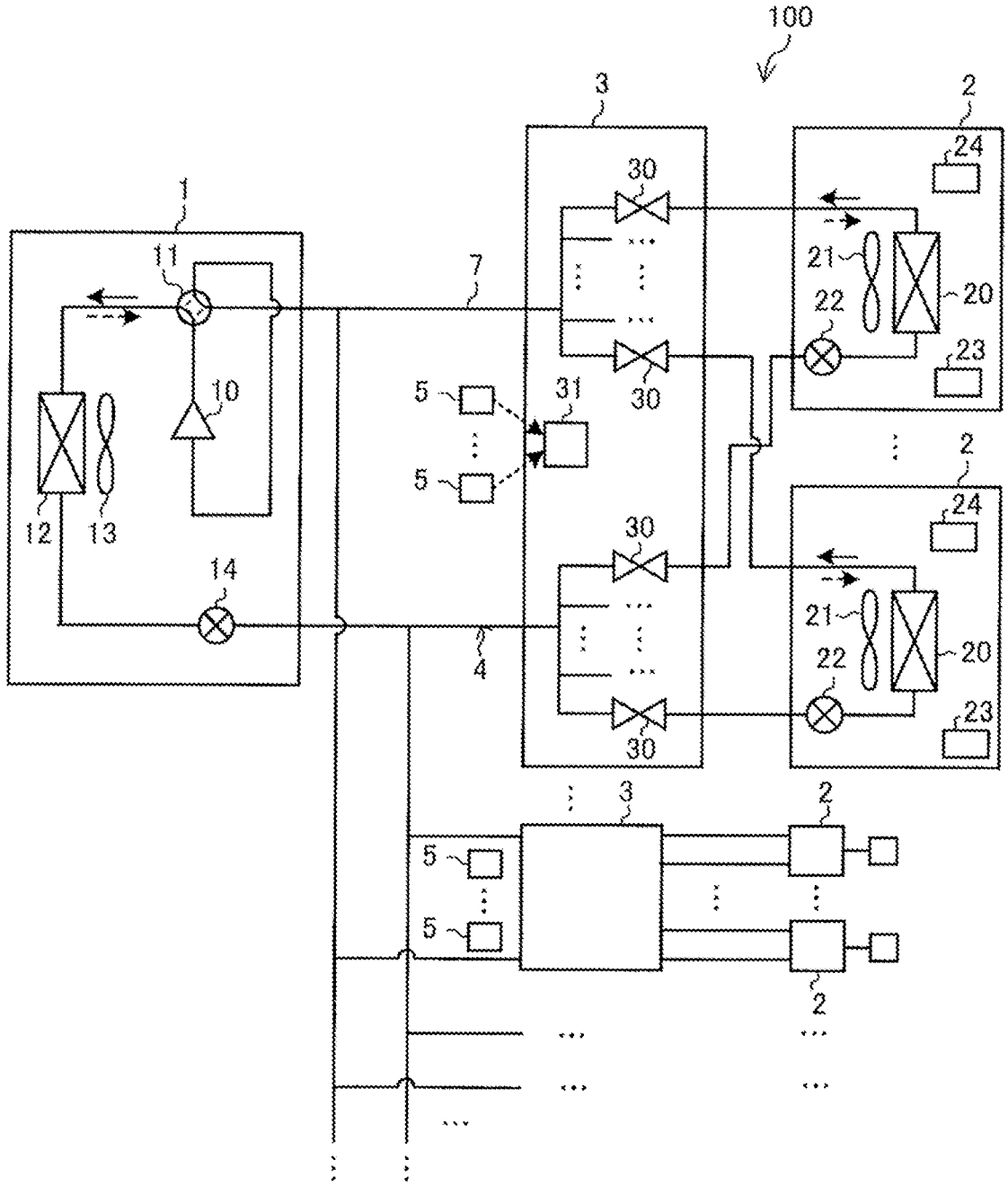
FIG. 1 is a schematic diagram illustrating an example of an air-conditioning system according to Embodiment.

Embodiment is described below with reference to the drawings. In the drawings below, size relationships among components may differ from real ones.

Embodiment

FIG. 1 is a schematic diagram illustrating an example of an air-conditioning system according to Embodiment. An air-conditioning system 100 according to Embodiment includes an outdoor unit 1, a plurality of indoor units 2, and one or more stop valve units 3. The outdoor unit 1, the plurality of indoor units 2, and the stop valve units 3 are connected together with a refrigerant pipe 7, and the refrigerant pipe 7 allows refrigerant to pass through its inside. Therefore, the refrigerant circulates through the outdoor unit 1 and the indoor units 2. Such a circuit in which the refrigerant circulates is described as a refrigerant circuit 4.

The refrigerant is charged into the outdoor unit 1. Depending on the number of indoor units 2 connected to the outdoor unit 1, the length of the refrigerant pipe 7, and other factors, the refrigerant may be further added. Thus, the refrigerant circuit 4 may be filled with the refrigerant that has the volume larger than or equal to the volume of the refrigerant charged into the outdoor unit 1.

Examples of the refrigerant in Embodiment may include refrigerant of HFO-1234yf alone, refrigerant of a mixture including HFO-1234yf, and hydrocarbon-based refrigerant, such as propane.

The outdoor unit 1 includes a compressor 10, a flow switching device 11, an outdoor heat exchanger 12, an outdoor air-sending device 13, and an outdoor flow control valve 14. The compressor 10, the flow switching device 11, the outdoor heat exchanger 12, and the outdoor flow control valve 14 are connected in sequence by the refrigerant pipe 7.

The compressor 10 is configured to compress refrigerant sucked from a suction port and discharge it as high-temperature and high-pressure gas refrigerant from a discharge port. The flow switching device 11 may include, for example, a four-way valve and is configured to switch directions of a flow of the refrigerant. By switching the flows of the refrigerant by use of the flow switching device 11, the operation is switched between cooling and heating. In FIG. 1, the solid line segments in the flow switching device 11 indicate flows of the refrigerant in cooling operation. The broken line segments indicate flows of the refrigerant in heating operation. Similarly, in FIG. 1, the arrows expressed by the solid lines indicate directions in which the refrigerant flows in cooling operation, and the arrows expressed by the broken lines indicate directions in which the refrigerant flows in heating operation.

The outdoor heat exchanger 12 is configured to exchange heat between the refrigerant and outdoor air. The outdoor heat exchanger 12 serves as a condenser for the refrigerant in cooling operation and serves as an evaporator for the refrigerant in heating operation. The outdoor air-sending device 13 includes a propeller fan drivable by a driving source, such as a fan motor, which is not illustrated, and is configured to guide the outdoor air to the outdoor heat exchanger 12 inside the outdoor unit 1 and to send air of which heat has been exchanged with the refrigerant to the outside.

The outdoor flow control valve 14 is also called an expansion valve and is configured to adjust the flow rate of the refrigerant circulating between the outdoor unit 1 and the indoor units 2 by changes in its opening degree and configured to decompress the refrigerant compressed in the compressor 10. In Embodiment, the opening degree of the outdoor flow control valve 14 is adjusted depending on the operation status of the indoor units 2. The outdoor flow control valve 14 may be disposed in the stop valve units 3, which are described below, in place of in the outdoor unit 1. Alternatively, the outdoor flow control valve 14 may be included in each of the outdoor unit 1 and the stop valve units 3.

Each of the indoor units 2 includes an indoor heat exchanger 20, an indoor air-sending device 21, an indoor flow control valve 22, a notification unit 23, and an indoor control unit 24. The notification unit 23 may be included in a remote controller, which is not illustrated, for the indoor unit 2.

The indoor heat exchanger 20 is configured to exchange heat between the refrigerant from the outdoor unit 1 and air inside the room. The indoor heat exchanger 20 is configured to cause heat exchange between the refrigerant and the air sent from the inside of the room into the indoor unit 2 by the indoor air-sending device 21.

The indoor air-sending device 21 includes a propeller fan drivable by, for example, a fan motor, which is not illustrated, and is configured to guide the air inside the room to the indoor heat exchanger 20 inside the indoor unit 2 and to send air of which heat has been exchanged with the refrigerant into the room. Like the outdoor flow control valve 14, the indoor flow control valve 22 is also called an expansion valve and is configured to adjust the flow rate of the refrigerant circulating between the outdoor unit 1 and the indoor unit 2 by changes in its opening degree. The notification unit 23 is configured to provide notification in accordance with an instruction from the indoor control unit 24, which is described below, in the case where the refrigerant leaks or in other cases.

The indoor control unit 24 is configured to control the indoor air-sending device 21, the indoor flow control valve 22, the notification unit 23, and other elements. The indoor control unit 24 is configured to cause the outdoor unit 1, the indoor unit 2, and other elements to perform an air-conditioning action desired by a user in accordance with an instruction from a remote controller, which is not illustrated. In the description below, a signal transmitted by the indoor control unit 24 to the outdoor unit 1 and other components in the indoor unit 2 including the indoor control unit 24 to cause performing the air-conditioning action desired by the user is described as a control signal.

The stop valve unit 3 in Embodiment is a unit disposed in the refrigerant circuit 4 including each of the one or more indoor units 2 inside the same room. The stop valve unit 3 is disposed between the outdoor unit 1 and the one or more indoor units 2 in the refrigerant circuit 4.

The stop valve unit 3 includes a plurality of stop valves 30 and an information processor 31. The stop valve unit 3 in Embodiment houses the plurality of stop valves 30 and the information processor 31 inside its casing.

Each of the stop valves 30 is disposed in the refrigerant circuit 4 between the outdoor unit 1 and the indoor unit 2. The stop valve 30 is configured to allow passage of the refrigerant through the refrigerant circuit 4 between the outdoor unit 1 and the indoor unit 2 by its opening action. The stop valve 30 is configured to stop the passage of the refrigerant through the refrigerant circuit 4 between the outdoor unit 1 and the indoor unit 2 by its closing action. The stop valve unit 3 in Embodiment includes the plurality of stop valves 30 disposed between the outdoor unit 1 and the one or more indoor units 2 inside a single room. The stop valve unit 3 may include the plurality of stop valves 30 disposed between the outdoor unit 1 and the plurality of indoor units 2 inside a plurality of rooms.

The information processor 31 is configured to exchange data with one or more refrigerant leak sensors 5. The one or more refrigerant leak sensors 5 are disposed in the same room as the room of the one or more indoor units 2 connected to the stop valve unit 3. The information processor 31 is configured to communicate with the indoor control unit 24 in each of the one or more indoor units 2 and to communicate with the outdoor unit 1. The refrigerant leak sensors 5 may be included in the stop valve unit 3. In this case, the stop valve unit 3 is placed in the same room as the room of the one or more indoor units 2. In Embodiment, the indoor units 2 and the refrigerant leak sensors 5 placed inside a single room and the stop valves 30 disposed between these indoor units 2 and the outdoor unit 1 are combined in a single group. In Embodiment, the stop valves 30 in the single group are housed in the stop valve unit 3.

The information processor 31 may be configured to communicate with each of the one or more refrigerant leak sensors 5 through a wire or wirelessly. In Embodiment, the information processor 31 is configured to communicate with the indoor control units 24 and the outdoor unit 1 wirelessly, and they may be configured to communicate with each other through a wire.

Each of the refrigerant leak sensors 5 is a sensor configured to detect the occurrence of a phenomenon where the refrigerant leaks from the refrigerant circuit 4 when such a phenomenon occurs. Examples of the refrigerant leak sensor 5 may include sensors of the oxygen concentration type, the combustible gas detection type, and other types.

When the refrigerant leak sensor 5 detects a leak of the refrigerant, the information processor 31 is configured to receive a signal indicating the leak of the refrigerant from the refrigerant leak sensor 5. When receiving the signal, the information processor 31 is configured to transmit a signal to the plurality of stop valves 30 in the stop valve unit 3, the outdoor unit 1, and the one or more indoor units 2 connected to the stop valve unit 3, and the signal requests an action programmed to be performed when the refrigerant leaks. In the description below, the signal requesting the predetermined action for the case where the leak of the refrigerant occurs may be described as a request signal. When receiving the signal indicating the leak of the refrigerant from at least one refrigerant leak sensor 5, the information processor 31 is configured to transmit the request signal to all of the stop valves 30 in the stop valve unit 3, all of the indoor units 2 connected to the stop valve unit 3, and the outdoor unit 1.

In the case where the single stop valve unit 3 includes the plurality of stop valves 30 disposed between the outdoor unit 1 and the plurality of indoor units 2 inside the plurality of rooms, the information processor 31 is configured to communicate with the refrigerant leak sensors 5 inside the corresponding ones of the plurality of rooms. In this case, the information processor 31 is configured to memorize the refrigerant leak sensors 5, the indoor units 2, and the stop valves 30 in units of groups for each room or for each plurality of neighboring rooms. When receiving the signal indicating the leak of the refrigerant from the refrigerant leak sensor 5 placed inside any one room, the information processor 31 is configured to transmit the request signal to all of the indoor units 2 and all of the stop valves 30 in the same group as the group of the refrigerant leak sensor 5 and the outdoor unit 1.

When receiving the request signal, the stop valves 30 are each configured to close a valve and to stop the passage of the refrigerant. Therefore, the inflow of the refrigerant into the indoor units 2 is prevented. While not receiving the request signal, the stop valves 30 are each configured to open or closes the valve in response to a control signal. The refrigerant is allowed to flow by the opening action of the stop valve 30, and its passage is stopped by the closing action.

The indoor control unit 24 in the indoor unit 2 receiving the request signal is configured to cause the indoor air-sending device 21 in the indoor unit 2 to perform processing for diffusing the leaking refrigerant in response to the request signal. Specifically, when the indoor air-sending device 21 is not in operation before the reception of the request signal, the indoor control unit 24 is configured to control the indoor air-sending device 21 such that the indoor air-sending device 21 starts its operation. When the indoor air-sending device 21 is in operation before the reception of the request signal, the indoor control unit 24 is configured to control the indoor air-sending device 21, for example, such that the indoor air-sending device 21 increases the quantity of air. The refrigerant is diffused by the operation of the indoor air-sending device 21.

Moreover, the indoor control unit 24 receiving the request signal is configured to control the notification unit 23 in the indoor unit 2 including the indoor control unit 24 such that the notification unit 23 issues a warning. The indoor control unit 24 receiving the request signal is configured to control the indoor flow control valve 22 in the indoor unit 2 such that the indoor flow control valve 22 closes its valve. In Embodiment, the indoor control unit 24 receiving the request signal is configured not to transmit the control signal to the outdoor unit 1.

In Embodiment, when receiving the request signal, the outdoor unit 1, in response to the request signal, the outdoor unit 1 is configured to control the compressor 10 such that the compressor 10 suspends its operation and to control the outdoor flow control valve 14 such that the outdoor flow control valve 14 closes its valve to prevent the refrigerant from flowing out toward the indoor units 2. When receiving the control signal from the indoor unit 2 together with the request signal, the outdoor unit 1 in Embodiment is configured to assign a higher priority to the action in accordance with the request signal and performs it. That is, when receiving at least one request signal, the outdoor unit 1 is configured to suspend the operation of the compressor 10 and to close the outdoor flow control valve 14.

Figure 2:
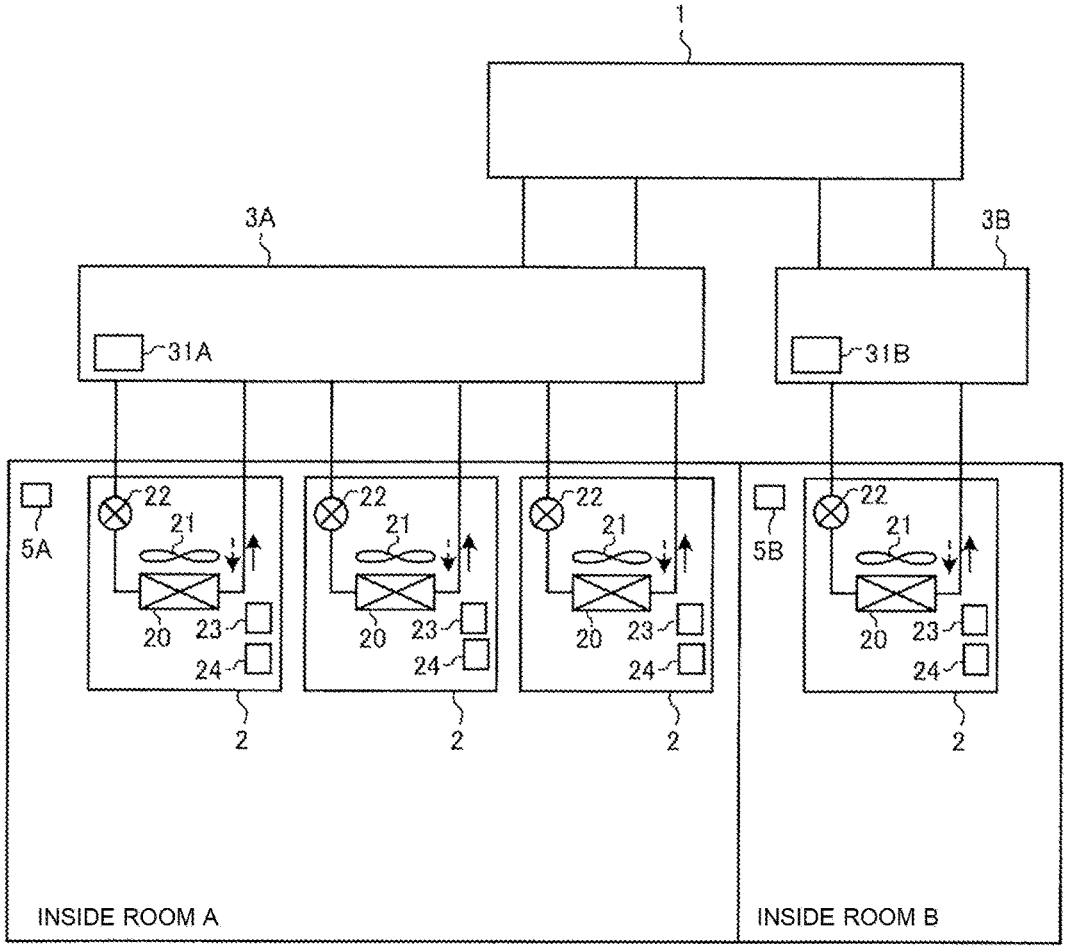
FIG. 2 is a schematic diagram for describing actions of the air-conditioning system when one or more indoor units are placed in each room.

A concrete example of actions of the air-conditioning system 100 according to Embodiment is described below with reference to FIG. 2. FIG. 2 is a schematic diagram for describing the actions of the air-conditioning system when one or more indoor units are placed in each room. FIG. 2 illustrates an example in which three indoor units 2 are placed inside a room A and a single indoor unit 2 is placed inside a room B. In this example, the stop valves 30 in the refrigerant circuit 4 including each of the one or more indoor units 2 in one room are combined in a group. Thus, the stop valves 30 in the refrigerant circuit 4 including each of the three indoor units 2 inside the room A and the stop valves 30 in the refrigerant circuit 4 including the single indoor unit 2 inside the room B belong to different groups. In the example illustrated in FIG. 2, the stop valves 30 and the refrigerant leak sensor 5 are included in the single stop valve unit 3 for each group. Thus, the stop valves 30 in the refrigerant circuit 4 including each of the three indoor units 2 inside the room A are housed in a single stop valve unit 3, and the stop valves 30 in the refrigerant circuit 4 including the single indoor unit 2 inside the room B are housed in a different single stop valve unit 3. The stop valves 30 and the refrigerant leak sensors 5 in a plurality of groups may be included in the single stop valve unit 3.

In the description below, the stop valve unit 3 including the stop valves 30 in the refrigerant circuit 4 including each of the three indoor units 2 inside the room A is described as a stop valve unit 3A. The stop valve unit 3 including the stop valves 30 in the refrigerant circuit 4 including the single indoor unit 2 inside the room B is described as a stop valve unit 3B.

The refrigerant leak sensor 5 is placed inside the room A. The refrigerant leak sensor 5 may be housed in the stop valve unit 3A. In the description below, the refrigerant leak sensor 5 placed inside the room A may be described as a refrigerant leak sensor 5A. The refrigerant leak sensor 5A is configured to communicate with the information processor 31 included in the stop valve unit 3A. In the description below, the information processor 31 included in the stop valve unit 3A may be described as an information processor 31A.

The refrigerant leak sensor 5 is placed inside the room B. The refrigerant leak sensor 5 may be housed in the stop valve unit 3B. In the description below, the refrigerant leak sensor 5 placed inside the room B may be described as a refrigerant leak sensor 5B. The refrigerant leak sensor 5B is configured to communicate with the information processor 31 included in the stop valve unit 3B. In the description below, the information processor 31 included in the stop valve unit 3B may be described as an information processor 31B.

The information processor 31A is configured to communicate with the indoor control unit 24 in each of the three indoor units 2 placed inside the room A. The information processor 31B is configured to communicate with the indoor control unit 24 in the single indoor unit 2 placed inside the room B.

When detecting a leak of the refrigerant, the refrigerant leak sensor 5A is configured to transmit a signal indicating the leak of the refrigerant to the information processor 31A. When receiving the signal, the information processor 31A is configured to transmit a request signal requesting the stop valves 30 included in the stop valve unit 3A to close their valves. The stop valves 30 included in the stop valve unit 3A are each configured to close the valve in accordance with the request signal. In the case where the above outdoor flow control valve 14 is disposed in the stop valve unit 3A, the information processor 31A is configured to transmit a request signal requesting the outdoor flow control valve 14 to close its valve. In this case, the outdoor flow control valve 14 is configured to close its valve in accordance with the request signal. The information processor 31A is configured to transmit a request signal to the indoor control unit 24 in each of the three indoor units 2 placed inside the room A. The indoor control unit 24 receiving the request signal is configured to control the notification unit 23 such that the notification unit 23 issues a warning, configured to control the indoor air-sending device 21 such that the indoor air-sending device 21 sends air for diffusing the leaking refrigerant, and configured to control the indoor flow control valve 22 such that the indoor flow control valve 22 closes its valve.

When detecting a leak of the refrigerant, the refrigerant leak sensor 5B is configured to transmit a signal indicating the leak of the refrigerant to the information processor 31B. When receiving the signal, the information processor 31B is configured to transmit a request signal requesting the stop valves 30 included in the stop valve unit 3B to close their valves. The stop valves 30 included in the stop valve unit 3B are each configured to close the valve in accordance with the request signal. In the case where the outdoor flow control valve 14 is disposed in the stop valve unit 3B, the information processor 31B is configured to transmit a request signal requesting the outdoor flow control valve 14 to close its valve. In this case, the outdoor flow control valve 14 is configured to close its valve in accordance with the request signal. The information processor 31B is configured to transmit a request signal to the indoor control unit 24 in the single indoor unit 2 placed inside the room B. The indoor control unit 24 receiving the request signal is configured to control the notification unit 23 such that the notification unit 23 issues a warning, configured to control the indoor air-sending device 21 such that the indoor air-sending device 21 sends air for diffusing the leaking refrigerant, and configured to control the indoor flow control valve 22 such that the indoor flow control valve 22 closes its valve.

When receiving the signal indicating the leak of the refrigerant, the information processors 31A and 31B are each configured to transmit the request signal to the outdoor unit 1. In response to the received request signal, the outdoor unit 1 is configured to control the compressor 10 such that the compressor 10 suspends its operation and configured to control the outdoor flow control valve 14 such that the outdoor flow control valve 14 closes its valve.

In the case where the stop valves 30 in the refrigerant circuits 4 including the indoor units 2 inside the rooms A and B are collectively included in the single stop valve unit 3, the information processor 31 included in the stop valve unit 3 is configured to communicate with the indoor control units 24 in the indoor units 2 arranged inside the rooms A and B. When receiving a signal indicating a leak of the refrigerant from the refrigerant leak sensor 5A, the information processor 31 is configured to transmit a request signal to the outdoor unit 1 and also transmit the request signal to the indoor units 2 and the stop valves 30 in the same group as the group of the refrigerant leak sensor 5A. Similarly, when receiving a signal indicating a leak of the refrigerant from the refrigerant leak sensor 5B, the information processor 31 is configured to transmit the request signal to the outdoor unit 1 and also transmit the request signal to the indoor unit 2 and the stop valves 30 in the same group as the group of the refrigerant leak sensor 5B.

A hardware configuration of the air-conditioning system 100 according to Embodiment is described below. The structure of each of the outdoor unit 1, the indoor heat exchanger 20, the indoor air-sending device 21, the indoor flow control valve 22, the stop valve 30, and the refrigerant leak sensor 5 is substantially the same as the structure in related art, and its description is omitted. The functions of the information processor 31 and the indoor control unit 24 can be achieved by, for example, a structure including a processor, such as a central processing unit (CPU) and a micro processing unit (MPU), a memory, such as a read-only memory (ROM) and a random-access memory (RAM), a communication interface circuit, and other elements. The communication functions of the information processor 31 and the indoor control unit 24 can be achieved by the use of the communication interface circuit. The functions of the information processor 31 other than the communication function can be achieved by the processor reading various programs stored in the memory and executing them. Similarly, the functions of the indoor control unit 24 other than the communication function can be achieved by the processor reading various programs stored in the memory and executing them. All or part of the functions of the information processor 31 and the indoor control unit 24 may be achieved by a dedicated hardware device.

Figure 3:
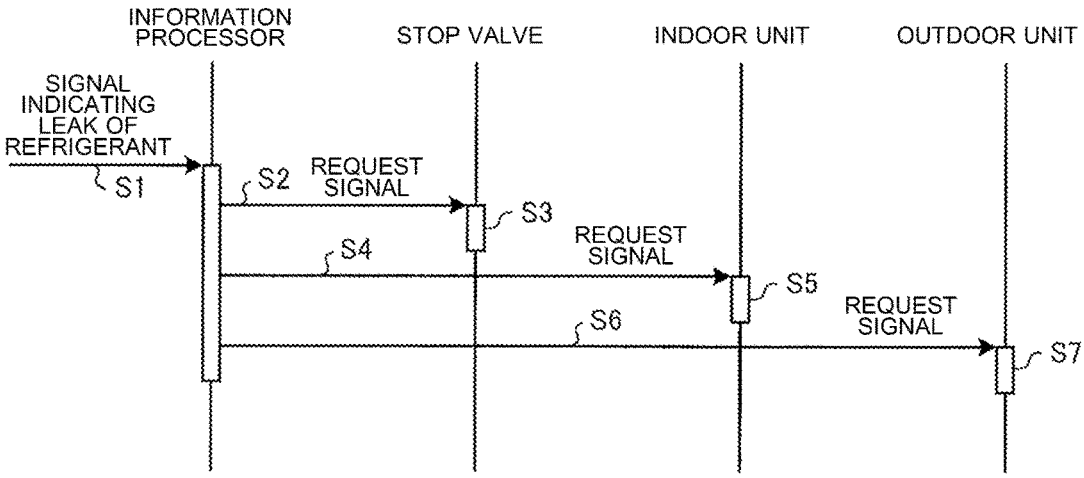
FIG. 3 is a sequence diagram illustrating an example flow of processing by the one or more indoor units, an outdoor unit, and a stop valve unit in the case where refrigerant is detected inside a room.

A flow of processing by the stop valve units 3, the outdoor unit 1, and the indoor units 2 in the case where the refrigerant is detected inside a room is described below. FIG. 3 is a sequence diagram illustrating an example flow of processing in the air-conditioning system in the case where the refrigerant is detected inside a room. Here, the indoor unit 2 belongs to the same group as the group of the refrigerant leak sensor 5 detecting the leak of the refrigerant.

At step S1, the information processor 31 receives a signal indicating a leak of the refrigerant from the refrigerant leak sensor 5. At step S2, the information processor 31 transmits a request signal to the stop valves 30 in the same group as the group of the refrigerant leak sensor 5. At step S3, the stop valve 30 receiving the request signal closes its valve in response to the request signal. At step S4, the information processor 31 transmits the request signal to the indoor unit 2 in the same group as the group of the refrigerant leak sensor 5. At step S5, the indoor control unit 24 receiving the request signal controls the notification unit 23 such that the notification unit 23 issues a warning. In response to the request signal, the notification unit 23 issues the warning. The indoor control unit 24 controls the indoor air-sending device 21 such that the indoor air-sending device 21 sends air for diffusing the leaking refrigerant. In response to the control, the indoor air-sending device 21 sends air for diffusing the leaking refrigerant. The indoor control unit 24 controls the indoor flow control valve 22 such that the indoor flow control valve 22 closes its valve. In response to the control, the indoor flow control valve 22 closes its valve.

At step S6, the information processor 31 transmits the request signal to the outdoor unit 1. At step S7, the outdoor unit 1 receiving the request signal controls the compressor 10 such that the compressor 10 suspends its operation and controls the outdoor flow control valve 14 such that the outdoor flow control valve 14 closes its valve. The processing at step S2, the processing at step S4, and the processing at step S6 may be performed in parallel to each other or in any order. The processing at step S3, the processing at step S5, and the processing at step S7 may be performed upon receipt of the request signal, in parallel to each other or in any order.

Figure 4:
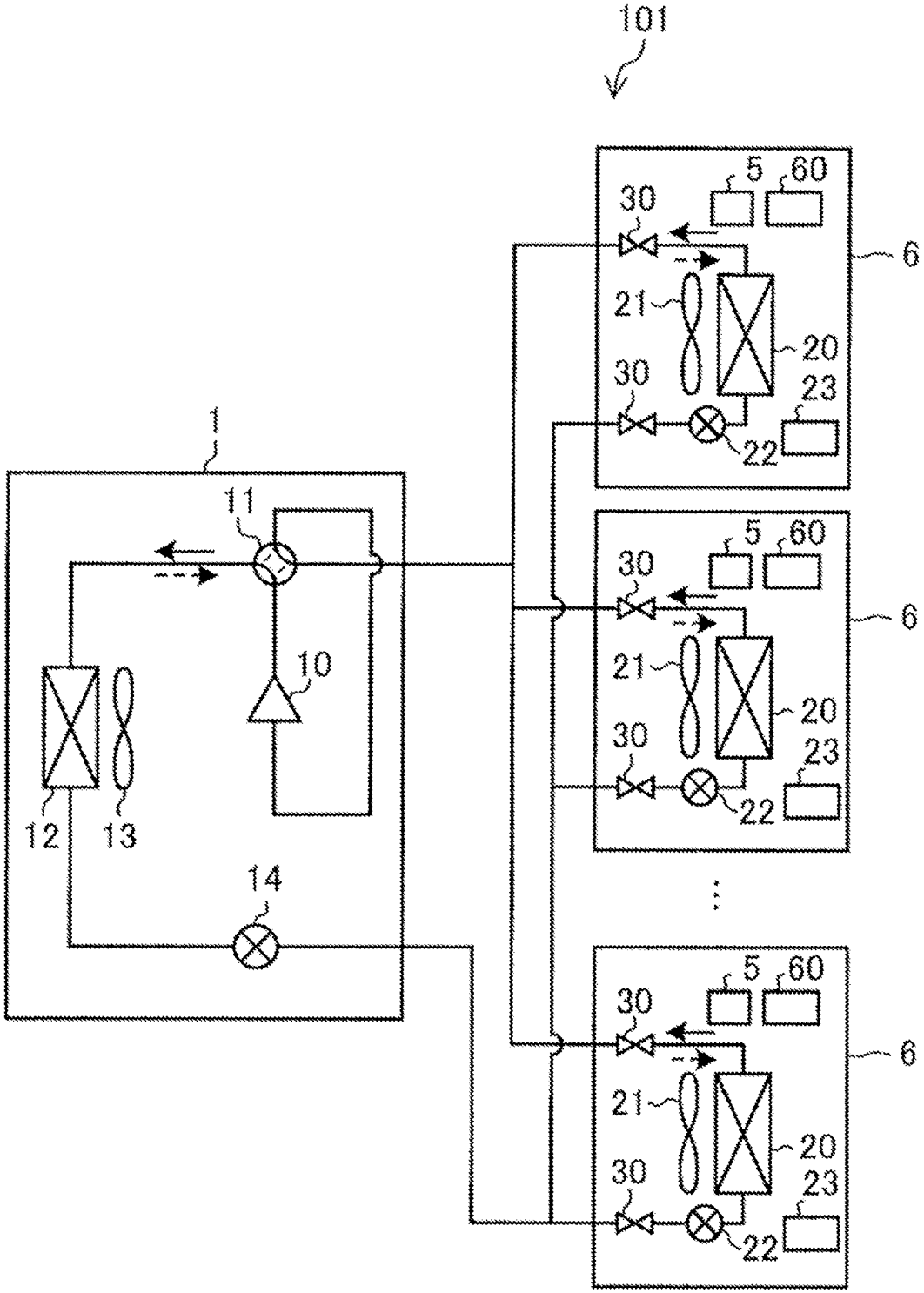
FIG. 4 is a schematic diagram illustrating an example of an air-conditioning system in related art.

Next, differences between the air-conditioning system 100 according to Embodiment and an air-conditioning system 101 in related art are described. FIG. 4 is a schematic diagram illustrating an example of the air-conditioning system in related art. The air-conditioning system 101 in related art includes the outdoor unit 1 and a plurality of indoor units 6 and does not include the stop valve units 3. In the air-conditioning system 101, in place of the above stop valve units 3, the stop valves 30 are disposed inside or outside each of the indoor units 6. In the air-conditioning system 101, the refrigerant leak sensor 5 is disposed inside or outside each of the indoor units 6. The indoor units 6 each include the above indoor heat exchanger 20, the above indoor air-sending device 21, the indoor flow control valve 22, and the notification unit 23, like the above-described indoor unit 2. The indoor units 6 each include an indoor controller 60 corresponding to the combination of the above information processor 31 and the above indoor control unit 24. That is, the indoor controller 60 in the indoor unit 6 in related art has the function of the above information processor 31.

In related art, when detecting a leak of refrigerant, the refrigerant leak sensor 5 in the indoor unit 6 is configured to transmit a signal indicating the leak of the refrigerant to the indoor controller 60 in the indoor unit 6. The indoor controller 60 in the indoor unit 6 in which the leak of the refrigerant is detected is configured to control the notification unit 23 such that the notification unit 23 issues a warning and configured to control the stop valves 30 and the indoor flow control valve 22 in the indoor unit 6 such that the stop valves 30 and the indoor flow control valve 22 close their valves. The indoor controller 60 in the indoor unit 6 is configured to transmit the request signal for the case where the refrigerant leaks to the outdoor unit 1.

When the refrigerant leak sensor 5 in the indoor unit 6 does not detect the leak of the refrigerant, the indoor controller 60 in the indoor unit 6 is configured to perform substantially the same processing as the processing by the above indoor control unit 24. Thus, the indoor controller 60 in the indoor unit 6 in which the leak of the refrigerant is not detected is configured to transmit a control signal for the case where the leak of the refrigerant is not detected to the outdoor unit 1.

The outdoor unit 1 is configured to perform the processing by using the request signal or the control signal from each of the plurality of indoor units 6. When, however, the number of indoor units 6 in the air-conditioning system 101 is large, the amount of data of signals to be processed by the outdoor unit 1 is large. The traffic in transmission and reception of signals between the outdoor unit 1 and the indoor units 6 is large.

Even when the outdoor unit 1 receives the request signal from an indoor unit 6 detecting the leak of the refrigerant, in a case where the outdoor unit 1 receives the control signal requiring an outflow of the refrigerant from another indoor unit 6, the outdoor unit 1 in related art may flow the refrigerant out toward the indoor unit 6. In the case where the plurality of indoor units 6 are placed inside the same room, however, problems described below may arise. A possible case where the refrigerant leak sensor 5 in the indoor unit 6 in which the refrigerant leaks does not detect the leak of the refrigerant and the refrigerant leak sensor 5 in another indoor unit 6 detects the leak of the refrigerant is discussed. In this case, the indoor unit 6 that does not detect the leak of the refrigerant may not close the stop valves 30 and may transmit the control signal requiring the outflow of the refrigerant to the outdoor unit 1. The processing by the outdoor unit 1 in response to the control signal may cause the refrigerant to flow into the indoor unit 6 and lead to further leaks of the refrigerant.

In related art, only the notification unit 23 in the indoor unit 6 in which the refrigerant leak sensor 5 detecting the leak of the refrigerant is disposed issues a warning about the leak of the refrigerant. In actuality, however, the leak of the refrigerant may occur in a different indoor unit 6, and, when the refrigerant leak sensor 5 in the different indoor unit 6 does not detect the leak of the refrigerant, a user of the different indoor unit 6 may not be sufficiently warned. Moreover, in related art, the indoor air-sending device 21 in the indoor unit 6 in which the refrigerant leak sensor 5 does not detect the leak of the refrigerant is disposed does not perform air-sending processing for reducing the concentration of the leaking refrigerant. Thus, when the refrigerant leak sensor 5 in the indoor unit 6 in which the refrigerant leaks does not detect the leak of the refrigerant, the refrigerant may accumulate, and such a configuration may lead to an increased concentration of the refrigerant.

Moreover, the air-conditioning system 101 in related art also has the following problems. For the air-conditioning system 100, the air-conditioning system 101, and other systems, all the refrigerant leak sensors 5 need to be changed to change the type of the refrigerant, to change the characteristics of the refrigerant leak sensors 5, to replace the refrigerant leak sensors 5 because of age deterioration, or in other cases. As described above, however, in the air-conditioning system 101 in related art, the refrigerant leak sensor 5 is disposed in each of the indoor units 6. Thus, when the number of indoor units 2 in the air-conditioning system 101 is large, the burden of work in replacing the refrigerant leak sensors 5 is significant. An example of the characteristics of the refrigerant leak sensors 5 may be a threshold value of the concentration of the refrigerant used in the refrigerant leak sensor 5 when it determines whether the refrigerant leaks or not. The threshold value depends on the type of the refrigerant or other factors.

In contrast to the air-conditioning system 101 in related art, the air-conditioning system 100 according to Embodiment has the following advantageous effects. First, in Embodiment, the stop valves 30 for stopping the inflow of the refrigerant into the one or more indoor units 2 inside the room are combined in the stop valve unit 3. When the refrigerant leak sensor 5 inside the room detects the leak of the refrigerant, the information processor 31 in the stop valve unit 3 is configured to receive the signal indicating the leak of the refrigerant from the refrigerant leak sensor 5. The information processor 31 receiving the signal is configured to transmit the request signal to the outdoor unit 1, the one or more indoor units 2, the stop valves 30, and other elements, and the request signal requests performing predetermined processing for the occurrence of the leak of the refrigerant. At this time, the one or more indoor units 2 receiving the request signal are each configured not to transmit the control signal to the outdoor unit 1. Thus, the traffic in the air-conditioning system 100 is to be reduced. When receiving at least one request signal, the outdoor unit 1 is configured to perform the processing in response to the request signal, and thus the amount of data processing can be reduced, in comparison with the case where processing using the control signal as well is performed.

When the outdoor unit 1 suspends its operation in response to the request signal, the inflow of the refrigerant toward the indoor units 2 is prevented. All the stop valves 30 receiving the request signal are each configured to perform the closing action in accordance with the request signal. When the outdoor flow control valve 14 is included in the stop valve unit 3, the information processor 31 is configured to transmit the request signal requesting closing to the outdoor flow control valve 14, and the outdoor flow control valve 14 is configured to close its valve in accordance with the request signal. Thus, the inflow of the refrigerant into all the indoor units 2 inside the room is prevented. Thus, situations where the refrigerant flows into the indoor unit 2 in which the refrigerant leaks can be prevented, and further leaks can be prevented.

In Embodiment, all the indoor units 2 in the same room are each configured to issue a warning indicating the leak of the refrigerant in accordance with the request signal. Thus, a user of the same room can be sufficiently notified. Because the indoor air-sending device 21 in each of all the indoor units 2 in the same room is configured to perform the air-sending operation for diffusing the refrigerant, the refrigerant is further diffused and the increase in concentration of the refrigerant is further prevented, in comparison with the air-conditioning system in related art.

In Embodiment, the refrigerant leak sensor 5 is disposed for not each indoor unit 2 but each group of indoor units 2 in the same room. The number of refrigerant leak sensors 5 disposed for the group of indoor units 2 may be one or more. The one or more refrigerant leak sensors 5 for the group of the indoor units 2 in the same room may be housed in the stop valve unit 3. Thus, in the case where the number of indoor units 2 in the air-conditioning system 100 is large or in other cases, the burden of the processing of replacing the refrigerant leak sensors 5 is to be reduced.

As described above, the air-conditioning system 100 according to Embodiment includes the outdoor unit 1, the plurality of indoor units 2, and the one or more refrigerant leak sensors 5. In the refrigerant circuit 4 in which the refrigerant is circulated, the outdoor unit 1 is configured to exchange heat between outdoor air and the refrigerant. In the refrigerant circuit 4, the indoor units 2 are each configured to exchange heat between the refrigerant and air inside the room and to perform air conditioning inside the room. The one or more refrigerant leak sensors 5 are each configured to detect a leak of the refrigerant from the refrigerant circuit 4. The refrigerant leak sensors 5 are each arranged separately from the outdoor unit 1 and the plurality of indoor units 2. Thus, work for the outdoor unit 1 and the plurality of indoor units 2 in replacing the refrigerant leak sensors 5 is not necessary. Accordingly, the burden of work of replacing the refrigerant leak sensors 5 is reduced.

In Embodiment, the number of refrigerant leak sensors 5 in the room is less than or equal to the number of indoor units 2 inside the room. Thus, the burden of work of replacing the refrigerant leak sensors 5 is reduced.

The air-conditioning system 100 in Embodiment further includes the plurality of stop valves 30 each configured to stop the inflow of the refrigerant into the plurality of indoor units 2 in the case where the refrigerant leaks. The plurality of stop valves 30 are each arranged separately from the outdoor unit 1 and the indoor units 2. Thus, work for the outdoor unit 1 and the indoor units 2 is not needed in work for the stop valves 30, and the burden of the work for the stop valves 30 is lightened.

The air-conditioning system 100 in Embodiment further includes the one or more stop valve units 3. The one or more stop valve units 3 each include the plurality of stop valves 30 housed in its casing. Thus, the burden of work for the stop valves 30 is further reduced.

The stop valve unit 3 in Embodiment includes the one or more refrigerant leak sensors 5. Therefore, the burden of replacement work for the refrigerant leak sensors 5 is further reduced.

The stop valve unit 3 in Embodiment further includes the information processor configured to control the plurality of stop valves 30 included in the stop valve unit 3. When detecting the leak of the refrigerant inside a room, the refrigerant leak sensor 5 is configured to transmit the signal indicating the leak of the refrigerant to the information processor 31. The information processor 31 is configured to control the plurality of stop valves 30 each configured to stop the inflow of the refrigerant into the one or more indoor units 2 placed inside a room as a single group. When receiving the signal indicating the leak of the refrigerant inside the room from the refrigerant leak sensor 5, the information processor 31 is configured to transmit the request signal to the plurality of stop valves 30 included in the group including the stop valves 30 each configured to stop the inflow of the refrigerant into the one or more indoor units 2 inside the room, and the request signal causes performing the predetermined action for the case where the refrigerant leaks. When receiving the request signal, the stop valves 30 are each configured to close the valve to stop the passage of the refrigerant in accordance with the request signal. Therefore, in the case where the leak of the refrigerant is detected inside the room, the leak of the refrigerant from the one or more indoor units 2 inside the room is prevented.

In Embodiment, the plurality of stop valves 30 each configured to stop the inflow of the refrigerant into the one or more indoor units 2 placed inside a room are included as a single group in the single stop valve unit 3. Therefore, the burden of work for the stop valves 30 each configured to stop the inflow of the refrigerant into the one or more inside a room is reduced.

In Embodiment, the one or more refrigerant leak sensors 5 placed inside each room are combined in the single group and are included in the single stop valve unit 3. Therefore, the burden of work for the refrigerant leak sensors 5 configured to detect the leak of the refrigerant for each rooms is lightened.

The stop valve unit 3 in Embodiment further includes the information processor 31. The information processor 31 31 is configured to control the plurality of stop valves 30 included in the stop valve unit 3. When detecting the leak of the refrigerant inside the room, the refrigerant leak sensor 5 is configured to transmit the signal indicating the leak of the refrigerant to the information processor 31. When receiving the signal indicating the leak of the refrigerant, the information processor 31 transmits, to the plurality of stop valves 30 included in the stop valve unit 3, the request signal for causing performing the predetermined action for the case where the refrigerant leaks. When receiving the request signal, the stop valves 30 are each configured to close the valve to stop the passage of the refrigerant in accordance with the request signal. Therefore, the air-conditioning system 100 according to Embodiment can stop the inflows of the refrigerant into the one or more indoor units 2 inside the room where the refrigerant leaks all at once, and the leak of the refrigerant can be reliably prevented.

When receiving the signal indicating the leak of the refrigerant, the information processor 31 in Embodiment is configured to transmit, to the outdoor unit 1, the request signal for causing performing the predetermined action for the case where the refrigerant leaks. When receiving the request signal, the outdoor unit 1 is configured to suspend its action in accordance with the request signal. In the case where the leak of the refrigerant is detected, because the request signal from the information processor 31 causes the outdoor unit 1 to suspend its action, the inflow of the refrigerant toward the indoor units 2 can be prevented, and further leaks of the refrigerant can be prevented.

The indoor unit 2 in Embodiment is configured to transmit the control signal for controlling the outdoor unit 1 to the outdoor unit 1. Therefore, the indoor units 2 can apply an air-conditioning operation desired by a user to the outdoor unit 1. When receiving the request signal, the outdoor unit 1 in Embodiment is configured to suspend its action in accordance with the request signal, even in a case where the outdoor unit 1 receives the control signal. Because the outdoor unit 1 suspends its action in accordance with the request signal even in a case where the outdoor unit 1 receives the control signal requiring the outflow of the refrigerant from another indoor unit 2, the inflow of the refrigerant toward the indoor unit 2 in which the refrigerant leaks can be prevented. Therefore, further leaks of the refrigerant can be prevented. The outdoor unit 1 is configured to suspend its action in response to the request signal alone, in place of the processing using the request signal and the control signal. Thus, the burden of data processing by the outdoor unit 1 can be reduced.

When receiving the signal indicating the leak of the refrigerant from the refrigerant leak sensor 5 detecting the leak of the refrigerant inside the room, the information processor 31 in Embodiment is configured to transmit the request signal to the one or more indoor units 2 inside the room. When receiving the request signal, the indoor units 2 are each configured not to transmit the control signal for controlling the outdoor unit 1 in accordance with the request signal. Therefore, the traffic in the air-conditioning system 100 is to be reduced. Because it is not necessary for the outdoor unit 1 to perform the processing of receiving the control signal and the processing using the control signal, the amount of processing by the outdoor unit 1 can be reduced.

When receiving the signal indicating the leak of the refrigerant from the refrigerant leak sensor 5 detecting the leak of the refrigerant inside the room, the information processor 31 in Embodiment is configured to transmit, to the one or more indoor units 2 inside the room, the request signal for causing performing the predetermined action for the case where the refrigerant leaks. The indoor unit 2 includes the indoor air-sending device 21 configured to send air into the room and the indoor control unit 24 configured to control the indoor air-sending device 21. When receiving the request signal from the information processor 31, the indoor control unit 24 is configured to control the indoor air-sending device 21 such that the indoor air-sending device 21 performs air-sending processing for diffusing the leaking refrigerant in accordance with the request signal. In the case where the leak of the refrigerant is detected inside the room, the information processor 31 is configured to transmit the request signal to the one or more indoor units 2 inside the room all at once, and the indoor air-sending device 21 in each of the indoor units 2 is configured to perform the air-sending processing in response to the request signal. Thus, the diffusion of the refrigerant inside the room is further promoted. Therefore, the rise in the concentration of the refrigerant inside the room can be prevented.

When receiving the signal indicating the leak of the refrigerant from the refrigerant leak sensor 5 detecting the leak of the refrigerant inside the room, the information processor 31 in Embodiment is configured to transmit, to the indoor units 2 inside the room, the request signal for causing performing the predetermined action for the case where the refrigerant leaks. The indoor unit 2 includes the notification unit 23 configured to provide notification of the leak of the refrigerant and the indoor control unit 24 configured to control the notification unit 23. When receiving the request signal from the information processor 31, the indoor control unit 24 is configured to control the notification unit 23 such that the notification unit 23 provides notification of the leak of the refrigerant in accordance with the request signal. In the case where the leak of the refrigerant is detected inside the room, the information processor 31 is configured to transmit the request signal to the one or more indoor units 2 inside the room all at once, and the indoor units 2 are each configured to issue a warning in accordance with the request signal. Thus, a user inside the room can be sufficiently notified of the leak of the refrigerant.

The invention claimed is:

1. An air conditioning system comprising:

an outdoor unit configured to exchange heat between outdoor air and refrigerant in a refrigerant circuit in which the refrigerant is circulated;

a plurality of indoor units disposed in at least one room, each of the plurality of indoor units being configured to exchange heat between the refrigerant in the refrigerant circuit and air inside the at least one room and to perform air-conditioning inside the at least one room;

one or more refrigerant leak sensors disposed in each of the at least one room, each of the one or more refrigerant leak sensors configured to detect a leak of the refrigerant from the refrigerant circuit; and one or more stop valve units, each corresponding with a respective room of the at least one room, and including a plurality of stop valves housed in its casing, the plurality of stop valves each being configured to stop an inflow of the refrigerant into at least one of the plurality of indoor units in a case where the refrigerant leaks, the one or more refrigerant leak sensors being each arranged separately from the outdoor unit and the plurality of indoor units, the one or more stop valve units each including an information processor configured to control the plurality of stop valves included in a corresponding one of the one or more stop valve units, the one or more refrigerant leak sensors being each configured to transmit a leakage signal to a respective information processor in a case where a leak of the refrigerant is detected inside the at least one room, the leakage signal indicating the leak of the refrigerant, the respective information processor being configured to control a corresponding plurality of stop valves each configured to stop the inflow of the refrigerant into one or more of the plurality of indoor units disposed in the at least one room and configured to, when receiving the leakage signal indicating the leak of the refrigerant from one of the one or more refrigerant leak sensors that detects the leak of the refrigerant inside the at least one room, transmit a request signal to one or more of the plurality of indoor units inside the at least one room, the request signal causing the one or more of the plurality of indoor units to perform a predetermined action of operating a fan, the plurality of indoor units each including a processor, configured to, when receiving the request signal, cause a warning of the leak of the refrigerant to issue, wherein:

the respective information processor is configured to, when receiving the leakage signal indicating the leak of the refrigerant, further transmit the request signal to the outdoor unit, the outdoor unit is configured to, when receiving the request signal, suspend its operation, the one or more of the plurality of indoor units are each configured to transmit a control signal to the outdoor unit, the control signal controlling the outdoor unit, the outdoor unit is configured to, when receiving the request signal, suspend its action in accordance with the request signal, even in a case where the outdoor unit receives the control signal, and the one or more of the plurality of indoor units receiving the request signal are each further configured so that before performing the predetermined action of operating the fan, the one or more of the plurality of indoor units do not transmit the control signal to the outdoor unit in accordance with the request signal when receiving the request signal.

* * * * *